United States Patent [19]

Anderson

[11] Patent Number: 4,770,321

[45] Date of Patent: Sep. 13, 1988

[54] DISPENSING MACHINE FOR MAGAZINES AND NEWSPAPERS

[76] Inventor: Raymond L. Anderson, P.O. Box 3031, Langley, British Columbia, Canada, V3A 4R3

[21] Appl. No.: 899,608

[22] Filed: Aug. 25, 1986

[51] Int. Cl.[4] ..... G07F 11/14; B65H 3/22

[52] U.S. Cl. ..... 221/100; 221/213; 221/232; 221/244; 221/248; 221/258

[58] Field of Search ..... 221/10, 13, 14, 213–216, 221/227, 228, 232, 240, 244, 246–249, 258, 100

[56] References Cited

U.S. PATENT DOCUMENTS

| | | | |
|---|---|---|---|
| 952,536 | 3/1910 | Lovatt | 221/213 X |
| 2,522,033 | 9/1950 | Graham | 221/232 X |
| 2,826,336 | 3/1958 | Anderson | 221/258 X |
| 2,832,506 | 4/1958 | Hatcher | 221/14 X |
| 4,508,238 | 4/1985 | Johnson et al. | 221/213 X |

*Primary Examiner*—F. J. Bartuska

*Attorney, Agent, or Firm*—Fetherstonhaugh & Co.

[57] ABSTRACT

A dispensing machine for use in dispensing publications such as magazines and newspapers is disclosed. It is comprised of a housing having a storage area for storing a plurality of publications, a cover for accessing the storage area, and an opening to allow the publication to be dispensed from the house. An adjustable support in the storage area is used for supporting the publications. A dispensing mechanism positioned above the support is adapted to dispense, through the opening, a publication. A mechanism is used for activating the dispensing mechanism and for adjusting the position of the support.

18 Claims, 5 Drawing Sheets

Fig. 1.
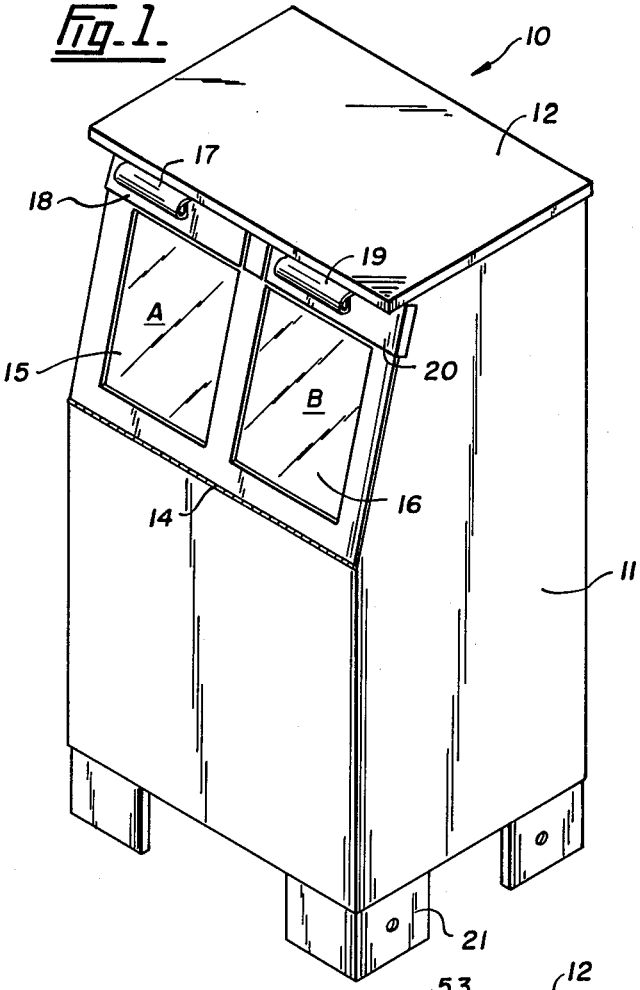
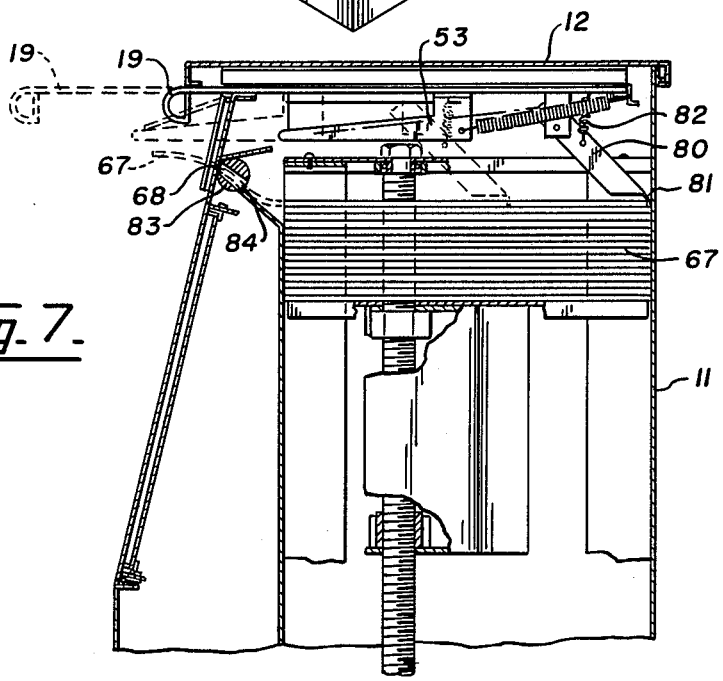
Fig. 7.

DISPENSING MACHINE FOR MAGAZINES AND NEWSPAPERS

FIELD OF THE INVENTION

This invention relates to newspaper and magazine dispensing machines and more particularly to a dispensing machine able to control the quantity of magazines that will be dispensed upon being activated.

DESCRIPTION OF THE PRIOR ART

Traditional newspaper and magazine dispensers whish are located at various street corners and building sites are mainly comprised of a storage compartment which is restricted by a display door secured by a coin activated release mechanism.

When the proper amount of coinage has been inserted, a release mechanism is activated allowing the display door to be pulled open. A problem associated with these prior art dispensing machines is that while opened, the content becomes exposed to the environment and the public. Theft and damage of the contents is therefore possible. Since there is a continual high cost of replacement, distributors of these publications have to limit the quantity in storage. This then results in an increased in servicing and attendant time.

There therefore exists a requirement for a newspaper and magazine dispenser which will restrict the access to the content after payment has been made and which will keep the remaining content secure by being physically unaccessible.

SUMMARY OF THE INVENTION

It is therefore an object of the present invention to provide a newspaper or magazine dispenser which will issue a single publication upon being activated.

Another object of the present invention is to provide a newspaper and magazine dispenser able to protect upon being activated, its content from the environment and theft.

Yet another object of the present invention is to provide a newspaper and magazine dispenser which is easy to use and which can be easily reloaded.

Accordingly, this invention provides a dispensing machine for dispensing publications such as magazines and newspapers comprising: Housing means having storage means for storing a plurality of publications, cover means for accessing said storage means, and opening means to allow said publication to be dispensed from said housing; adjustable support means in said storage means for supporting said publications; means positioned above said adjustable support means adapted to dispense, through said opening means, a publication supported on said support means; means for activating said dispensing means; and means for adjusting position of said support means as said publications are being dispensed.

DRAWINGS

Particular embodiments of the invention will be understood in conjunction with the accompanying drawings in which:

FIG. 1 is an isometric view of the dispensing machine of the present invention;

Figure 3A:
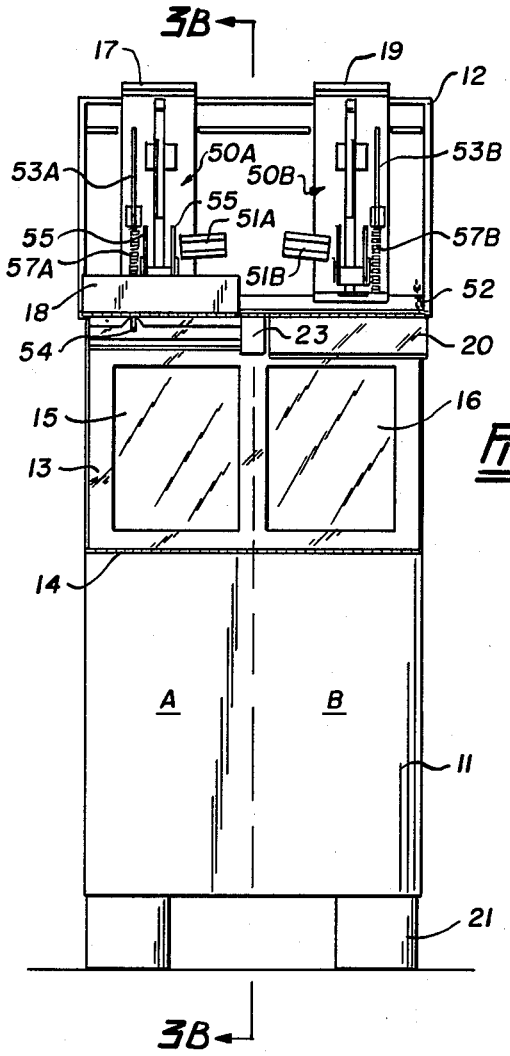
Figure 3B:
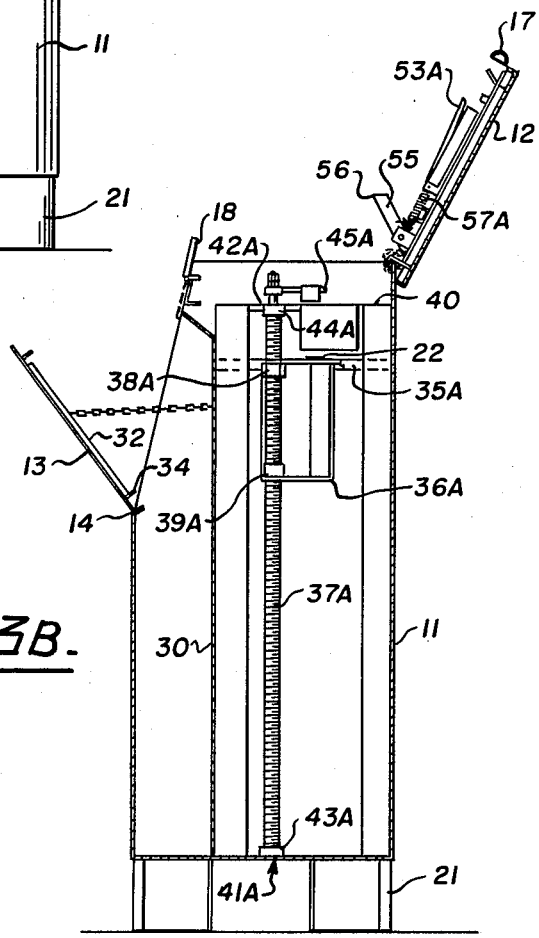

FIG. 3*a* is a front view thereof with the lid open;

FIG. 3*b* is a section taken along lines 3b—3b of FIG. 3*a;*

Figure 4:
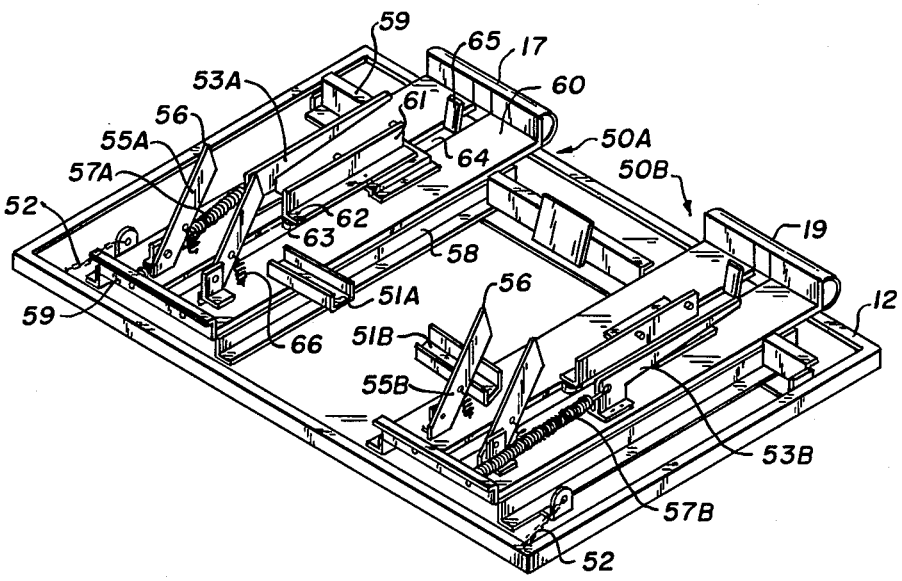
Figure 5:
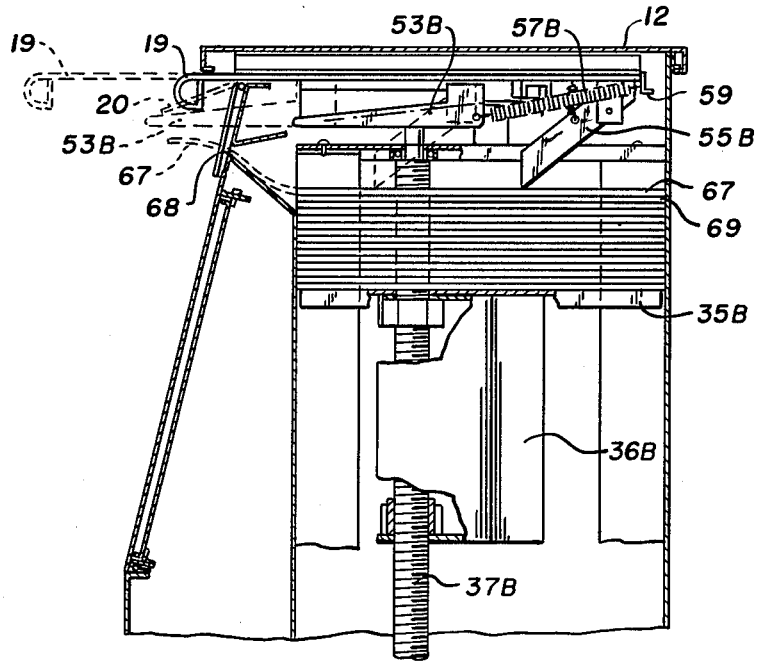
Figure 6:
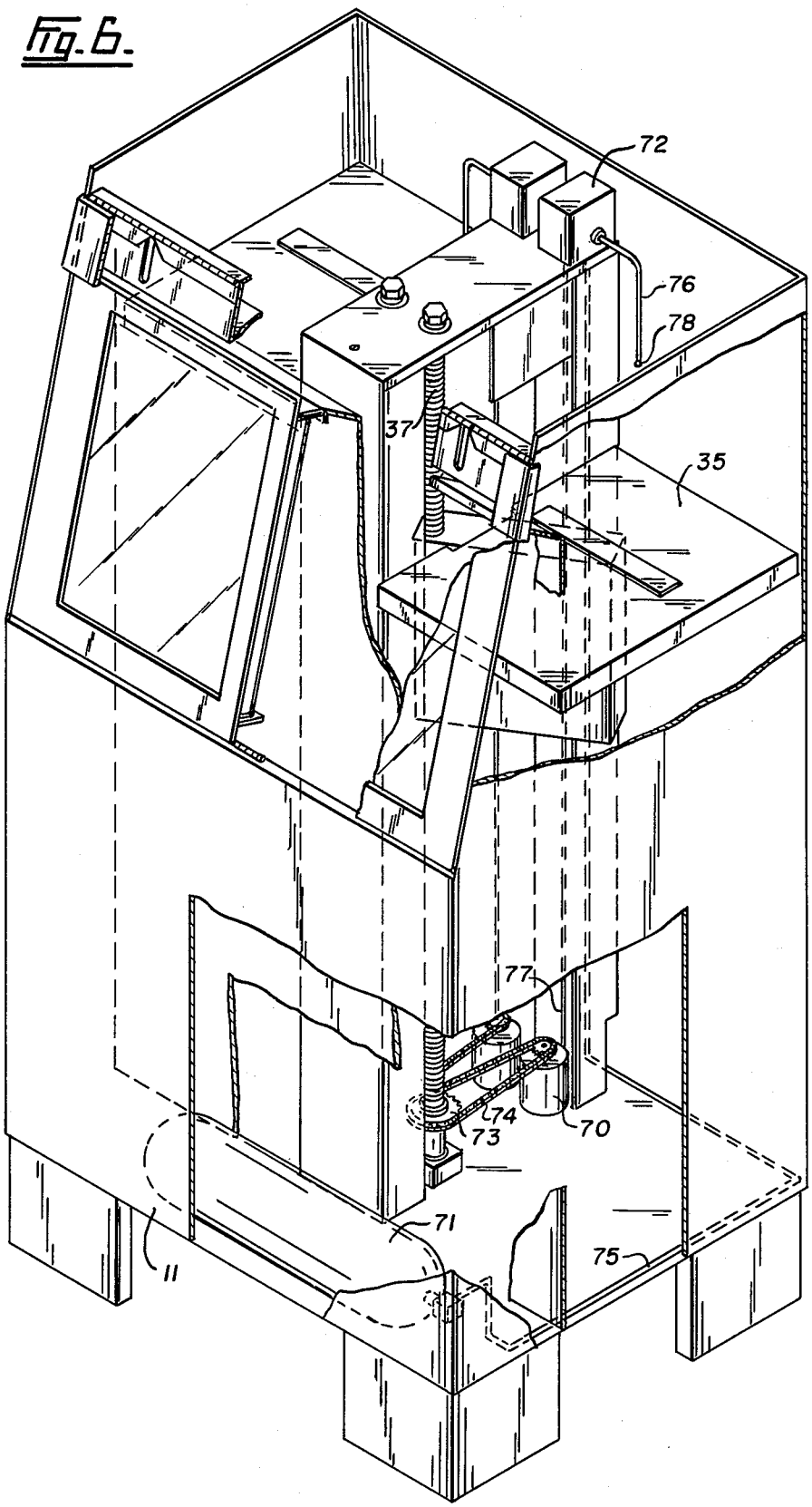

FIG. 4 is a bottom view of the housing lid cover;

FIG. 5 is a sectional view of the top portion of the housing showing the dispensing handle partially open;

FIG. 6 is a partially sectioned isometric view according to another embodiment of the invention; and FIG. 7 is a sectional view of the portion of the housing according to another embodiment of the invention.

DESCRIPTION OF THE PREFERRED EMBODIMENT

Referring now to FIG. 1 shown at reference numeral 10 is an isometric view of the newspaper and magazine dispensing machine disclosed in the present invention. The dispensing machine is comprised of a housing 11 with a removable cover 12 and a magazine display door 13 pivotably mounted on hinge 14.

In the present embodiment, the dispensing machine is provided with two publication storage compartments A and B. A sample of the content of storage compartment A can be shown in display window 15 and a sample of the content of storage compartment B can be shown in display window 16.

As will be further described below, a copy of publication A can be dispensed by pulling handle 17 which is slidably mounted under cover 12 to engage an ejecting mechanism to dispense a magazine through a dispensing opening (not shown) behind dispensing door 18. Similarly, a copy of the publications contained in storage compartment B can be obtained by pulling handle 19 slidably mounted below cover 12 thereby dispensing a publication under dispensing door 20.

The dispensing machine housing 11 can be provided with a set of supporting legs 21 which can be secured to a set of cement blocks to prevent the theft of the dispensing machine as well as prevent accidental tilting in heavy winds.

Figure 2:
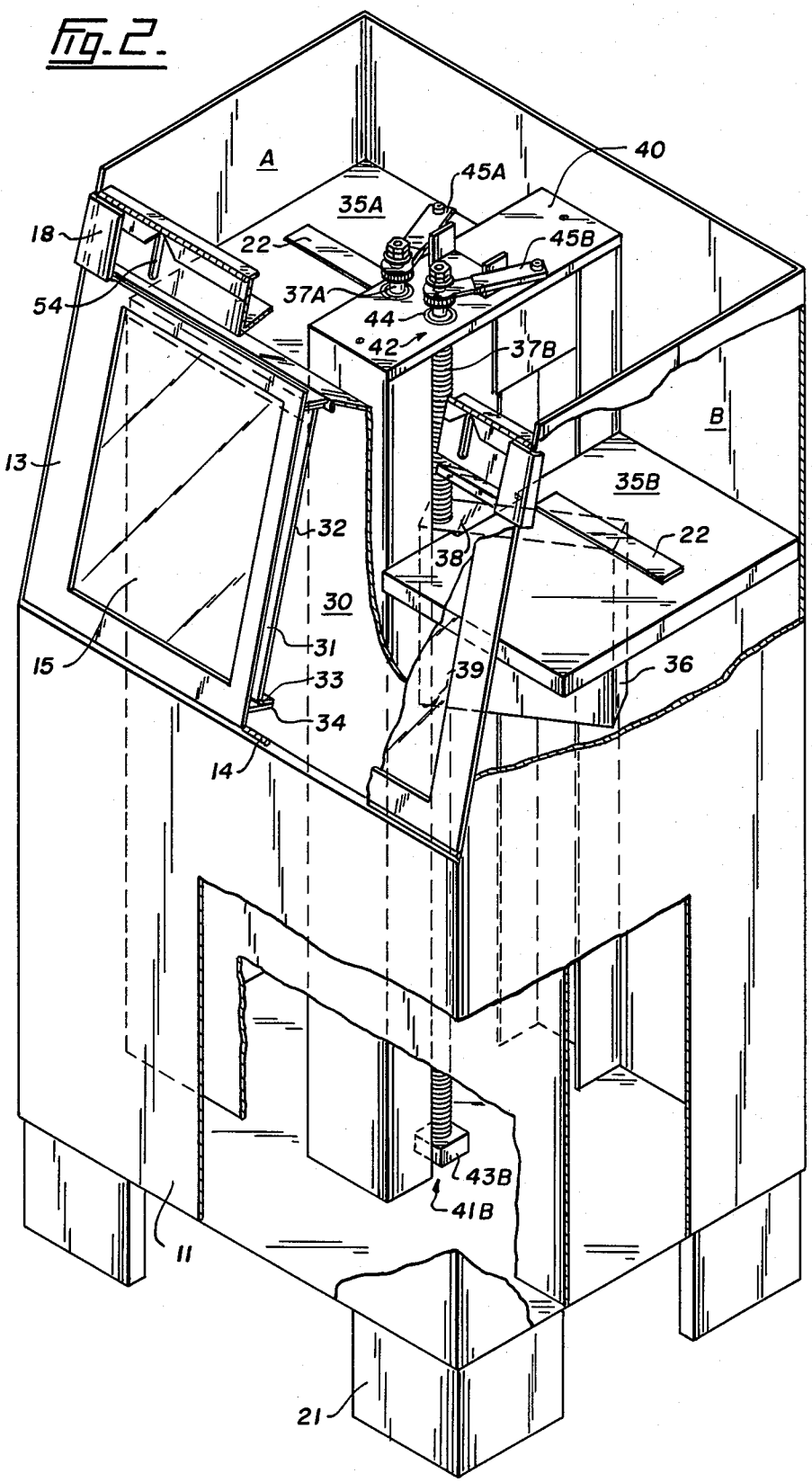
FIG. 2 is a partially sectioned isometric view of the dispensing machine of the present invention.

FIG. 2 shows a partially sectioned view of the dispensing machine with the cover removed for clarity. As can be more clearly shown housing 11 is basically separated into two storage compartments A and B. The storage compartments are separated from the outside display windows by means of an inner wall 30. Display door 13 is provided with a sample display storage compartment 31 with a pivotable back panel 32 mounted on hinge 33. Hinge 33 is secured to a display door support panel 34 which can either be bolted or welded to display door 13.

Each storage compartment is provided with a support tray 35 mounted over a securing bracket 36 which, as will be seen later, is secured to a threaded delivery rod 37 by means of a threaded bolt secured at its top end 38 and a needle bearing sleeve arrangement at its bottom end 39. The threaded delivery rods 37 are secured to a central rod support 40 at its base 41 and its top end 42 by means of bearings 43 and 44 respectively. Each delivery rod 37 is provided with a ratchet drive 45 which is used to rotate delivery rods 37 thereby lifting support trays 35. Delivery rods **37*a* and 37*b* have opposite threads such that when ratchet drive 45*a* is rotated rearwardly, support tray 35*a* will be raised and when ratchet drive 45*b* is rotated rearwardly, support tray 35*b*** will also move upwardly.

As will be discussed below, ratchet drives **45*a* and 45*b* are rotated forwardly when handles 17 and 19, shown in FIG. 1, are activated. Ratchet drives 45*a* and 45*b* are of course provided with means for changing the rotation of delivery rods 37***a* and 37*b* so as to permit the lowering of support tray 35*a* and 35*b* when re-loading is required.

If we now refer to FIGS. 3*a* and 3*b*, we have shown at FIG. 3*a* a front view of the dispensing machine of the present invention with cover 12 open and in FIG. 3*b* a sectional right-hand view taken along the centre line of the dispensing machine. With cover 12 open the dispensing mechanism is more clearly shown. Storage compartment A is provided with dispensing mechanism 50*a* and is activated by handle 17. Storage compartment B is provided with dispensing mechanism 50*b* and is activated by handle 19.

Lateral projections 51*a* and 51*b* on dispensing mechanisms 50*a* and 50*b* respectively, will engage with ratchet drives 45*a* and 45*b* respectively when lid 12 is pivoted down on housing 11.

As more clearly shown in FIG. 3*b*, display door 13 can be pivoted about hinge 14 so as to permit access to display windows 15 and 16 which include a sample of the publications stacked in storage compartments A and B. Cover 12 is supported in the open position by means of chain 52 and a cover locking flange (not shown). Projection members 53*a* and 53*b* are used to open door flaps 18 and 20 upon activating the dispensing mechanism by pulling on handle 17 and 19. Upon pulling handle 17, projection member 53*a* will penetrate slot 54 to open door flap 18 and permit a magazine to be dispensed. A set of delivery feet 55 makes contact with the uppermost publication and due to sharp corners 56 or a traction surface will slightly penetrate the first page to permit the dispensing of the publication when the dispensing mechanism is activated. The dispensing mechanisms are spring-loaded by means of a spring 57 which will permit the automatic return of the dispensing mechanism after a first publication has been released and ejected.

Referring now to FIG. 4 we have more clearly shown the dispensing mechanism assembly as supported by cover 12. A support structure 58 is used to secure the dispensing mechanism to cover 12. Hinge 59, used to pivot the lid 12 on housing 11, forms part of support structure 58. Handle 17 is secured to sliding plate 60 and can be moved relative support structure 58 and retaining plate 61 which is secured to support structure 58 at a number of rivet points 62. A series of bearings 63 are positioned along supporting plate 61 and journalled within slot 64 of sliding plate 60. Retaining spring 57*a* is secured between projection member 53*a* and hinge 59. A retaining flap 65 is used to prevent the forced opening of door flap 18 and 20 when the releasing mechanism is not being used. Delivery feet 55 are held against the uppermost publication by means of compressive springs 66.

In operation, upon pulling handle 19 as shown in FIG. 5, delivery feet 55*b* will make contact with the uppermost magazine 67 to push it through slot opening 68 while projection member 53*b* will push open door flap 20 to permit easy dispensing of publication 67 as depicted by the phantom lines. The lateral projection member 51*b* will rotate ratcheting arm or ratchet drive 45*b* forwardly such that upon returning handle 19 to its original position, ratcheting arm 45*b* will rotate rearwardly, rotating threaded delivery rod 37*b* and thereby raising support 35*b* such that the second uppermost publication 69 can become available for dispensing.

Once the last publication has been dispensed, a foot stop 22 more clearly shown in FIG. 2 will prevent the dispensing mechanism from being activated.

When empty an attentant can reload the dispensing machine by removing the cover 12 by means of a lock positioned under door flap 23 shown in FIG. 3*a*. The cover is slid rearwardly to clear support structure 58 and raised to a vertical position giving access to the storage compartments and the frontal display or display door 13. Display door 13 can then be pivoted about hinge 14 to permit the removal of the sample publications seen through display windows 15 and 16.

The attendant can then use a wrench which may be supplied with the dispensing machine to lower support trays 35*a* and 35*b* to the desired level and to permit reloading of the storage compartments with the desired number of publications.

Referring now to FIG. 6 we have shown another embodiment of the adjusting mechanism used in raising the support trays in their proper positions required for the operation of the dispensing machine. The drive mechanism for delivery rods 37 has been replaced by a pneumatic motor 70 connected to an air source such as compressed air cylinder 71 and air valve 72. Pneumatic motor 70 is mechanically linked to delivery rod 37 by means of a gear 73 and chain 74. Compressed air from cylinder 71 is fed to air valve 72 by means of conduit 75 which can be positioned along the base of housing 11 to air valve 72. The rechanging of the main supply tank can be done by attaching a hand held source of compressed air/gas to an air valve fitting (not shown). The airvalve is provided with a mechanical switching arrangement 76 which is used to activate and de-activate switch 72. Switching lever 76 is positioned so that upon ejecting a first publication, contact on switching member 76 from the uppermost publication will be removed thereby turning on valve 72 to allow air to flow through conduit 77 to motor 70 thereby permitting rotation of delivery rod 77 until the next uppermost publication on tray 35 begins making contact with switching member 76 raising it to the off position and thereby closing airvalve 72. Switching member 76 can basically consist of a simple spring-loaded toggle switch which always flips back to its original position when contact between the uppermost publication and tip 78 of switching member 76 is removed.

Similarly, pneumatic motor 70 could be replaced by an electrical motor connected to a power source via an electrical switch which would be positioned at air valve 72.

In the embodiment shown in FIG. 7, the ejector means or metal feet 80 are provided with a lip 81 which extends beyond a tip of metal feet 80 so as to reach the trailing edge of an uppermost publication to permit the dispensing of that publication when handle 19 is pulled. A compression spring 82 is positioned to apply pressure on ejector 80. This embodiment is also provided with a slotted roller 83 positioned at opening 68 and which is pivotably mounted in housing 11 such that upon pulling handle 19 projection member 53 will rotate roller 83 so as to permit the alignment of slot 84 of roller 83 with the slot of opening 68 thereby allowing the uppermost publication 67 to be dispensed out of housing 11. Upon returning handle 19 to its closed position, roller 83 will rotate to close opening 68.

I claim:

1. A dispensing machine for dispensing publications such as magazines and newspapers, comprising:

housing means having storage means for storing a plurality of publications, cover means for assessing said storage means, an horizontal slot opening to allow such publications to be dispensed from said storage means, a pivotable door mounted to said housing and covering said slot;

adjustable support means in said storage means for supporting said publications;

ejector means adapted to pull an uppermost publication from said support means to said horizontal slot;

a supporting plate with a handle at one end slidably mounted to said cover means with said ejector means mechanically connected thereto, said handle extending beyond said housing means;

a projecting member secured to said plate, facing said horizontal slot and adapted to push said pivotable door open when said handle is pulled;

a locking flap extending below said handle to rest against said pivotable door to prevent opening of said door until said handle is pulled outwardly of said housing; and means for adjusting the position of said support means as said publications are being dispensed.

2. A dispensing machine as defined in claim 1 wherein said housing means further comprises display means for displaying a sample publication.

3. A dispensing machine as defined in claim 1 wherein said adjusting means comprises threaded rod means vertically mounted in said housing and support at its bottom and top end by bearing means, drive means for rotating said rods and wherein said support means is secured to said rod means such that said support means can be raised and lowered in said storage means by rotation of said rod means.

4. A dispensing machine as defined in claim 3 wherein said drive means comprises ratcheting drive means secured at said top end of said rod means and adapted to rotate said rod means.

5. A dispensing machine as defined in claim 4 wherein said ratcheting drive means comprises a member having at one end a ratchet mechanism and connecting means at its other end on an upperface of said member, said connecting means being adapted to be slidably received in a channel of a receiving member attached to said support plate and extending laterally thereof, such that when said support plate slides in said cover means, said channel will engage said connecting means thereby pivoting said ratcheting member about said ratchet mechanism.

6. A dispensing machine as defined in claim 5 wherein said ratchet mechanism has a reversible action such that when activated, said adjustable support means can be lowered in said storage means.

7. A dispensing machine as defined in claim 6 wherein said support means comprises a tray adapted to slide in said storage means and having a securing member with an upper and lower securing point along said rod means, said upper securing point being threaded and adapted to receive said rod means, said lower securing point being slidably mounted to said rod means.

8. A dispensing machine as defined in claim 3 wherein said drive means comprises gear means mechanically linked to said motor means.

9. A dispensing machine as defined in claim 8 wherein said motor means comprises an electrical motor.

10. A dispensing machine as defined in claim 8 wherein said motor means comprises a pneumatic motor.

11. A dispensing machine as defined in claim 9 wherein said electrical motor is activated by switching means adapted to activate said motor when a publication has been dispensed.

12. A dispensing machine as defined in claim 10 wherein said pneumatic motor is activated by switching means adapted to activate said motor when a publication has been dispensed.

13. A dispensing machine as defined in claim 11 wherein said switching means comprises a spring loaded electrical switch positioned above the uppermost publication and connected between a power source and said electrical motor, said switch being in the off state when depressed by the uppermost publication such that upon dispensing the uppermost publication, the switch will change to the on state thereby activating said electrical motor for rotating said rod means.

14. A dispensing machine as defined in claim 12 wherein said switching means comprises a spring loaded air valve positioned above the uppermost publication and connected between an air source and said pneumatic motor, said air valve being closed when depressed by the uppermost publication such that upon dispensing said publications said air valve will become open allowing air to flow from said source through said pneumatic motor thereby rotating said rod means.

15. A dispensing machine as defined in claim 1 wherein said ejector means are pivotably mounted to said supporting plate and spring loaded to maintain downward pressure on an uppermost publication.

16. A dispensing machine as defined in claim 15 wherein said ejector means comprises metal protrustions having a sharp corner edge for engaging said uppermost publication such that when said handle is pulled, said metal protrusions will slightly penetrate a top page of said uppermost publication to push said publication to said opening means.

17. A dispensing machine as defined in claim 15 wherein said ejector means comprises protrusions having a lip extending to a rearward edge of said uppermost publication such that when said handle is pulled, said lip will engage with said rearward edge to pull said publication through said opening means.

18. A dispensing machine as defined in claim 15 wherein said supporting plate is spring loaded such that upon pulling and releasing said handle, said plate will automatically return to its original position.

* * * * *